US008651066B2

(12) United States Patent
Zhang et al.

(10) Patent No.: US 8,651,066 B2
(45) Date of Patent: Feb. 18, 2014

(54) PULSE DETONATION CLEANING SYSTEM

(75) Inventors: Tian Xuan Zhang, Overland Park, KS (US); David Michael Chapin, Overland, KS (US); Robert Warren Taylor, Ponte Vedra Beach, FL (US)

(73) Assignee: BHA Altair, LLC, Franklin, TN (US)

( * ) Notice: Subject to any disclaimer, the term of this patent is extended or adjusted under 35 U.S.C. 154(b) by 671 days.

(21) Appl. No.: 12/892,593

(22) Filed: Sep. 28, 2010

(65) Prior Publication Data

US 2012/0073611 A1 Mar. 29, 2012

(51) Int. Cl.
*F28G 11/00* (2006.01)

(52) U.S. Cl.
USPC ..... 122/379; 122/383; 122/390; 122/396; 122/405; 134/105

(58) Field of Classification Search
USPC ..... 122/383, 390, 396, 405, 379
See application file for complete search history.

(56) References Cited

U.S. PATENT DOCUMENTS

| | | | | |
|---|---|---|---|---|
| 5,901,550 | A | 5/1999 | Bussing et al. | |
| 5,937,635 | A * | 8/1999 | Winfree et al. | 60/39.38 |
| 6,678,483 | B2 | 1/2004 | Brown et al. | |
| 6,684,823 | B1 * | 2/2004 | Plavnik et al. | 122/379 |
| 6,980,765 | B2 | 12/2005 | McStravick et al. | |
| 7,011,047 | B2 | 3/2006 | Aarnio et al. | |
| 7,047,908 | B2 | 5/2006 | Henderson | |
| 7,104,223 | B2 | 9/2006 | Bussing | |
| 7,131,260 | B2 * | 11/2006 | Dean et al. | 60/39.76 |
| 7,267,134 | B2 | 9/2007 | Hochstein, Jr. et al. | |
| 7,442,034 | B2 | 10/2008 | Chenevert et al. | |
| 7,669,406 | B2 | 3/2010 | Tangirala et al. | |
| 7,739,867 | B2 * | 6/2010 | Kenyon et al. | 60/247 |
| 8,176,739 | B2 * | 5/2012 | Evulet et al. | 60/733 |
| 2002/0078679 | A1 * | 6/2002 | Kaemming et al. | 60/204 |
| 2003/0044192 | A1 | 3/2003 | Brown et al. | |
| 2005/0103022 | A1 * | 5/2005 | Kraft | 60/776 |
| 2005/0109231 | A1 | 5/2005 | Bussing | |
| 2005/0111893 | A1 | 5/2005 | McStravick et al. | |
| 2005/0112516 | A1 | 5/2005 | Aarnio et al. | |
| 2005/0125930 | A1 | 6/2005 | Flatness et al. | |
| 2005/0125931 | A1 | 6/2005 | Chenevert et al. | |
| 2005/0125932 | A1 | 6/2005 | Kendrick | |
| 2005/0125933 | A1 * | 6/2005 | Hochstein et al. | 15/304 |

(Continued)

FOREIGN PATENT DOCUMENTS

| | | | |
|---|---|---|---|
| AU | 2004229043 | A1 | 6/2005 |
| AU | 2004229043 | B2 | 6/2005 |

(Continued)

*Primary Examiner* — Kang Hu
*Assistant Examiner* — Nathaniel Herzfeld
(74) *Attorney, Agent, or Firm* — Reinhart Boerner Van Deuren P.C.

(57) ABSTRACT

A pulse detonation cleaning system is provided and includes a common tube, which is fluidly coupled to a vessel, a first array, including a plurality of elongate detonation tubes arrayed about a common axis, each of the plurality of the detonation tubes being disposed upstream from and fluidly coupled to an interior of the common tube and a second array, including a plurality of detonators arrayed about the common axis, each of the plurality of the detonators being disposed upstream from and operably coupled to a corresponding one of the plurality of the detonation tubes such that actuation of each of the plurality of the detonators leads to combustion in the corresponding one of the plurality of the detonation tubes.

18 Claims, 2 Drawing Sheets

(56) References Cited

U.S. PATENT DOCUMENTS

| | | | | |
|---|---|---|---|---|
| 2005/0126511 | A1 | 6/2005 | Henderson | |
| 2005/0126512 | A1 | 6/2005 | Kendrick et al. | |
| 2005/0126594 | A1 | 6/2005 | Chenevert et al. | |
| 2005/0126595 | A1 | 6/2005 | Flatness et al. | |
| 2005/0126597 | A1 | 6/2005 | Hochstein et al. | |
| 2005/0130084 | A1 | 6/2005 | Aarnio et al. | |
| 2005/0199743 | A1 | 9/2005 | Hochstein et al. | |
| 2006/0185623 | A1 | 8/2006 | Aarnio et al. | |
| 2006/0254252 | A1* | 11/2006 | Rasheed et al. | 60/39.38 |
| 2007/0180811 | A1* | 8/2007 | Rasheed et al. | 60/39.76 |
| 2008/0092828 | A1 | 4/2008 | Flatness et al. | |
| 2008/0127637 | A1 | 6/2008 | Henderson | |
| 2008/0155959 | A1* | 7/2008 | Rasheed et al. | 60/39.76 |
| 2008/0264357 | A1 | 10/2008 | Liljegren et al. | |
| 2008/0271685 | A1* | 11/2008 | Lupkes et al. | 122/396 |
| 2008/0292998 | A1 | 11/2008 | Hochstein, Jr. et al. | |
| 2008/0314278 | A1* | 12/2008 | Salignon et al. | 102/374 |
| 2009/0102203 | A1* | 4/2009 | Lu et al. | 290/40 R |
| 2009/0229068 | A1 | 9/2009 | Henderson et al. | |
| 2009/0277479 | A1 | 11/2009 | Lupkes | |
| 2009/0293817 | A1* | 12/2009 | Dean et al. | 122/379 |
| 2009/0320439 | A1* | 12/2009 | Chapin et al. | 60/39.38 |
| 2012/0180738 | A1* | 7/2012 | Zhang et al. | 122/379 |

FOREIGN PATENT DOCUMENTS

| | | | |
|---|---|---|---|
| AU | 2004229044 | A1 | 6/2005 |
| AU | 2004229044 | B2 | 6/2005 |
| AU | 2004229046 | A1 | 6/2005 |
| AU | 2004229046 | B2 | 6/2005 |
| AU | 2004229047 | A1 | 6/2005 |
| AU | 2004229047 | B2 | 6/2005 |
| CN | 1618535 | A | 5/2005 |
| CN | 1618536 | | 5/2005 |
| CN | 1623690 | | 6/2005 |
| CN | 1626287 | | 6/2005 |
| CN | 1626288 | | 6/2005 |
| CN | 1626289 | | 6/2005 |
| CN | 1626290 | | 6/2005 |
| CN | 1626291 | | 6/2005 |
| CN | 1626292 | | 6/2005 |
| CN | 1323771 | C | 7/2007 |
| CN | 1323772 | C | 7/2007 |
| CN | 2929643 | | 8/2007 |
| DE | 102004055912 | A1 | 6/2005 |
| DE | 102004055915 | A1 | 6/2005 |
| DE | 102004055916 | A1 | 6/2005 |
| EP | 1533048 | A1 | 5/2005 |
| EP | 1533049 | A1 | 5/2005 |
| EP | 1533050 | A1 | 5/2005 |
| EP | 1985382 | A2 | 10/2008 |
| EP | 1987895 | A1 | 11/2008 |
| EP | 1995547 | A2 | 11/2008 |
| GB | 2408555 | A | 6/2005 |
| GB | 2408556 | A | 6/2005 |
| GB | 2408557 | A | 6/2005 |
| GB | 2408784 | A | 6/2005 |
| GB | 2409013 | A | 6/2005 |
| GB | 2408784 | B | 6/2007 |
| GB | 2409013 | B | 9/2007 |
| GB | 2408556 | B | 10/2007 |
| GB | 2408555 | B | 12/2007 |
| JP | 2005-164229 | | 6/2005 |
| JP | 2005-186061 | | 7/2005 |
| JP | 2008-202906 | | 9/2008 |
| NZ | 536699 | | 11/2006 |
| RU | 2280516 | C1 | 5/2006 |
| RU | 2285567 | C2 | 10/2006 |
| WO | 2007/079220 | A2 | 7/2007 |
| WO | 2008/051296 | A2 | 5/2008 |
| WO | 2008/051297 | A2 | 5/2008 |
| WO | 2008/051298 | A2 | 5/2008 |
| WO | 2008/066592 | A1 | 6/2008 |
| WO | 2009/102464 | A1 | 8/2009 |
| WO | 2009/137771 | A2 | 11/2009 |
| WO | 2009/137771 | A3 | 11/2009 |

* cited by examiner

PULSE DETONATION CLEANING SYSTEM

BACKGROUND OF THE INVENTION

The subject matter disclosed herein relates to a pulse detonation cleaning system.

For systems that employ combustion of fossil fuels, the bi-products of the combustion operations include pollutants emitted into the atmosphere and soot deposited onto surfaces of vessel receptive of exhaust gases. These vessels include boilers, such as heat recovery steam generators (HRSG), that are coupled to combustors of, for example, gas turbine engines, such that combustor exhaust and heat may be collected in the HRSG interior for steam generation. The combustor exhaust is then largely exhausted into the atmosphere but may leave behind soot or another type of residue on the interior surface of the HRSG sidewall.

In order to clean boiler surfaces, such as the interior surface of the HRSG sidewall, detonation tubes are often employed. In these cases, the detonation tubes are coupled to the boilers and are supplied with fuels and/or gases that can be fired into the boiler interior. This firing, if it is powerful enough, has the effect of cleaning the interior surfaces as the soot/residue builds up.

BRIEF DESCRIPTION OF THE INVENTION

According to one aspect of the invention, a pulse detonation cleaning system is provided and includes a common tube, which is fluidly coupled to a vessel, a first array, including a plurality of elongate detonation tubes arrayed about a common axis, each of the plurality of the detonation tubes being disposed upstream from and fluidly coupled to an interior of the common tube and a second array, including a plurality of detonators arrayed about the common axis, each of the plurality of the detonators being disposed upstream from and operably coupled to a corresponding one of the plurality of the detonation tubes such that actuation of each of the plurality of the detonators leads to combustion in the corresponding one of the plurality of the detonation tubes.

According to another aspect of the invention, a pulse detonation cleaning system is provided and includes a common tube having a sidewall having an interior facing, cylindrical surface formed to define a common tube interior, which is fluidly coupled to a boiler interior, a first array, including a plurality of elongate detonation tubes arrayed about a common axis, each of the plurality of the detonation tubes being disposed upstream from and fluidly coupled to the common tube interior at a radial location proximate to the interior facing surface and a second array, including a plurality of detonators arrayed about the common axis, each of the plurality of the detonators being disposed upstream from and operably coupled to a corresponding one of the plurality of the detonation tubes such that actuation of each of the plurality of the detonators leads to combustion in the corresponding one of the plurality of the detonation tubes.

According to another aspect of the invention, a pulse detonation cleaning system is provided and includes a common tube having a sidewall having an interior facing surface formed to define a common tube interior, which is fluidly coupled to a boiler interior, a first array, including a plurality of elongate detonation tubes arrayed with longitudinal axes thereof transversely oriented with respect to a longitudinal axis of the common tube, a plurality of curved transition pieces, each of the plurality of the transition pieces being fluidly interposed between a corresponding one of the plurality of the detonation tubes and the common tube interior at a radial location proximate to the interior facing surface and a second array, including a plurality of detonators arrayed with longitudinal axes thereof transversely oriented with respect to the longitudinal axis of the boiler, each of the plurality of the detonators being disposed upstream from and operably coupled to a corresponding one of the plurality of the detonation tubes such that actuation of each of the plurality of the detonators leads to combustion in the corresponding one of the plurality of the detonation tubes.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
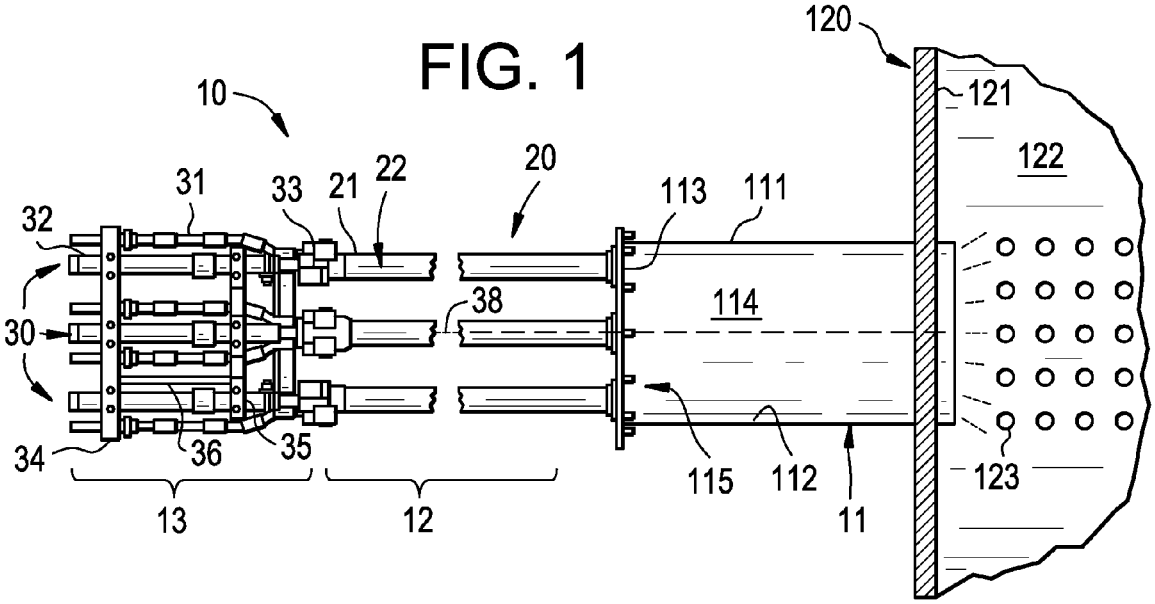
FIG. 1 is a side view of a pulse detonation cleaning system.
Figure 2:
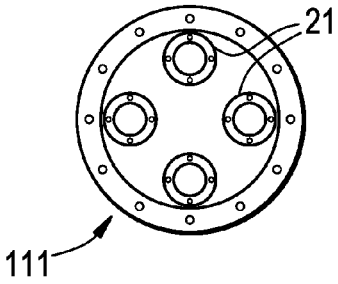
FIG. 2 is an axial view of the pulse detonation cleaning system of FIG. 1.
Figure 3:
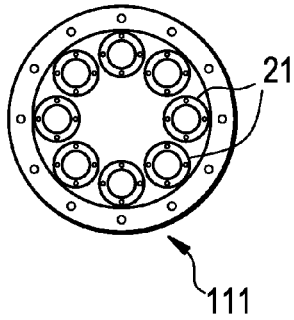
FIG. 3 is an axial view of the pulse detonation cleaning system of FIG. 1 with an increased number of detonation tubes.

With reference to FIGS. 1-3, a pulse detonation cleaning system 10 is provided and includes a common tube 11 including a sidewall 111 having an interior facing, cylindrical surface 112 and a cover plate 113. When assembled together, the interior facing surface 112 and the cover plate 113 are cooperatively formed to define a common tube interior 114 with through-holes 115 defined at the cover plate 113 and at a radial locations proximate to the interior facing surface 112. The common tube 11 may be connected to a vessel to be cleaned. As an example, the common tube 11 may be connected to a boiler 120 of a gas turbine engine at a boiler wall 121, which is formed to define a boiler interior 122 having a heat exchanger tube banks 123 operably disposed therein such that the common tube interior 114 and the boiler interior 122 are fluidly communicative. The pulse detonation cleaning system 10 further includes a first array 12 of a plurality of elongate detonation tubes 20 and a second array 13 of a plurality of detonators 30.

The first array 12 includes the plurality of the elongate detonation tubes 20 arrayed in, for example, an ovoid, circular, regular polygonal and/or irregular polygonal shape about a common axis 38, which is, in some embodiments, aligned with a longitudinal axis of the common tube 11. Each of the plurality of the detonation tubes 20 includes a tubular sidewall 21 that is formed to define an elongate pathway 22 therein. The tubular sidewall 21 is coupled to the cover plate 113 at a corresponding through-hole 115 proximate to the interior facing surface 112 such that each of the plurality of the detonation tubes 20 is disposed upstream from the common tube 11 with the elongate pathway 22 fluidly coupled to the common tube interior 114 proximate to the interior facing surface 112 and, for example, to the boiler interior 122 in sequence.

The second array 13 includes the plurality of the detonators 30 arrayed in, for example, an ovoid, circular, regular polygonal and/or irregular polygonal shape about the common axis 38. The array shape of the second array 13 may be similar to or unique from the array shape of the first array 12. Each of the plurality of the detonators 30 is disposed upstream from and operably coupled to a corresponding one of the plurality of the detonation tubes 20.

Each of the plurality of the detonators 30 includes an initiator 31, a fuel supply line 32, a valve 33 and a support structure. The initiator 31 is configured to carry a supply of combustible fuel and/or gas and to initiate a detonation thereof. This detonation can lead to combustion in the corresponding one of the plurality of the detonation tubes 20. The fuel supply line 32 may be plural in number and includes various types of fuel conduits by which fuel is deliverable to the corresponding one of the plurality of the detonation tubes 20. The valve 33 is fluidly interposed between the initiator 31, the fuel supply line 32 and the corresponding one of the plurality of the detonation tubes 20 and may be opened to permit the delivery of the fuel or closed to inhibit the fuel delivery of the fuel.

The support structure mechanically supports the initiator 31 and the fuel supply line 32 and includes first and second members 34, 35 and a connecting member 36. The first and second members 34, 35 extend transversely with respect to the common axis 38 to support the initiator 31 and the fuel supply line 32. The connecting member 36 extends along the common axis 38 and is supportively coupled to the first and second members 34, 35. As shown in FIG. 1, each support structure may be rotated relative to an adjacent support structure such that at least ample space is provided for the components of each.

Actuation of each of the plurality of the detonators 30 involves an opening of the valve 33, an initiation of combustion within the initiator 31 and a supplying of fuel to the elongate pathway 22. As the combustion proceeds within the initiator 31, a resulting flame propagates toward and into the elongate pathway 22 at which point the supplied fuel is fired and ignited. This ignition leads to combustion of the supplied fuel within the elongate pathway 22 and production of the pressure wave for the corresponding one of the plurality of the detonation tubes 20.

With the configuration described above, as the plurality of the detonators 30 are actuated and combustion occurs in the elongate pathways 22 of the plurality of the detonation tubes 20, pressure waves induced by the combustion in each of the plurality of the detonation tubes 20 are combinable with the pressure waves of the others of the plurality of the detonation tubes 20 as they enter the common tube interior 114. The resulting combined pressure wave within the common tube interior 114 is multiple times larger than the individual pressure waves and, since the plurality of the detonation tubes 20 are positioned at radial locations proximate to the interior facing surface 112, the combined effective pressure wave can be focused in order to remove undesirable material during cleaning operations.

As shown in FIGS. 2 and 3, each of the plurality of the detonation tubes 20 may be displaced from an adjacent one of the plurality of the detonation tubes 20 although this is merely exemplary and not required. The plurality of the detonation tubes 20 and the common tube 11 may each have various circumferential dimensions such that various number of the plurality of the detonation tubes 20 can be coupled to a single common tube 11. For example, 4 or more detonation tubes 20, and 4 or more detonators 30 may be arrayed about the common axis 38 in some exemplary embodiments whereas 8 or more detonation tubes 20 and 8 or more detonators 30 may be arrayed about the common axis 38 in other exemplary embodiments.

Figure 4:
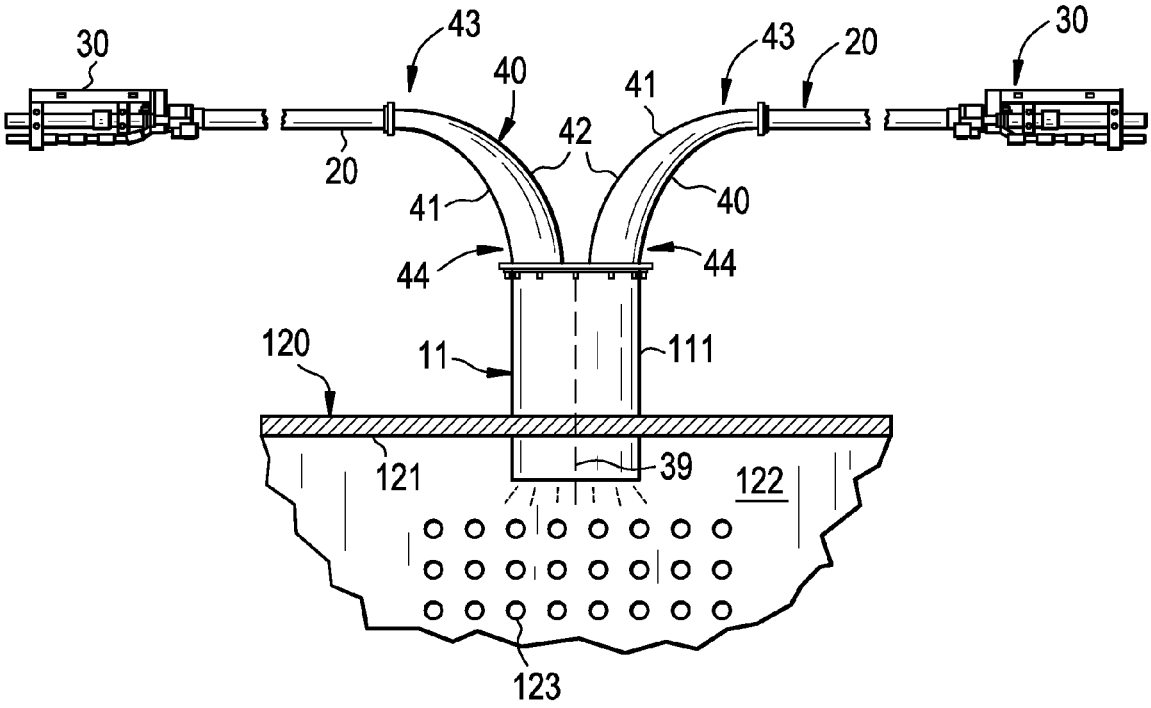
FIG. 4 is a side view of a pulse detonation cleaning system have transition pieces.
Figure 5:
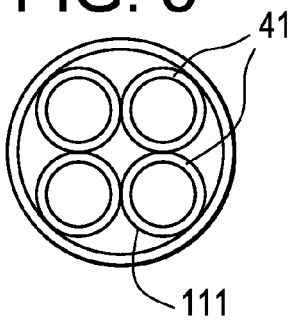
FIGS. 5 and 6 are axial views of the pulse detonation cleaning system of FIG. 4.
Figure 6:
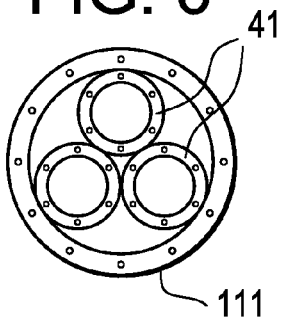

With reference to FIGS. 4-6, longitudinal axes of the plurality of the detonation tubes 20 and the plurality of the detonators 30 may be transversely oriented with respect to a longitudinal axis 39 of the common tube 11. In this case, a transition piece 40 may be fluidly coupled to and interposed between each of the plurality of the detonation tubes 20 and the common tube 11. The transition piece 40 includes a transition piece sidewall 41 that is formed to define a curved pathway 42 from an open upstream end 43, which is fluidly coupled to the corresponding one of the plurality of the detonation tubes 20, to an open downstream end 44, which is fluidly coupled to the common tube interior 114. Thus, the pressure wave induced by the combustion in each of the plurality of the detonation tubes 20 travels into the curved pathway 42 of the corresponding transition piece 40 via the upstream end 43 and to the downstream end 44 before being directed to enter the common tube interior 114.

As shown in FIGS. 5 and 6, the transition pieces 40 are generally tightly arranged at the entrance to the common tube interior 114 with, for example, 4 transition pieces 40 disposed in a rectangular array, or, for another example, 3 transition pieces disposed in a triangular array.

Where the longitudinal axes of the plurality of the detonation tubes 20 and the plurality of the detonators 30 form angles with the longitudinal axis 39 of the common tube 11, overall curvatures of the transition pieces 40 are substantially similar to those angles. Thus, if the longitudinal axes of the plurality of the detonation tubes 20 and the plurality of the detonators 30 form right angles with the longitudinal axis 39 of the common tube 11, the transition pieces 40 in this arrangement would have about 90 degrees of overall curvature. In addition, since the elongate pathways 22 are generally narrow as compared to the through-holes defined at the cover plate 113, the transition pieces 40 are generally tapered and increase in width from the upstream end 43 to the downstream end 44 with a substantially parabolic shape or some other similar shape. In accordance with further embodiments, however, it is to be understood that combustion dynamics and other considerations may require that the overall curvature of the transition pieces 40 and the tapering thereof be modified from the above descriptions.

Figure 7:
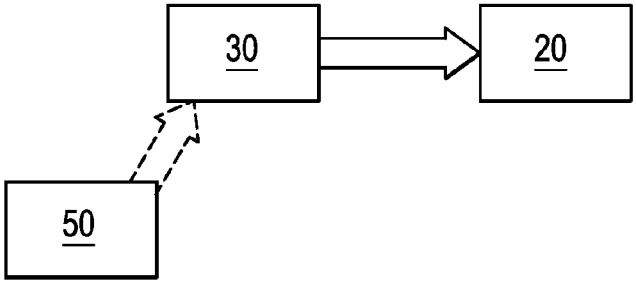
FIG. 7 is a schematic view of a control system of a pulse detonation cleaning system.

With reference to FIG. 7, the pulse detonation cleaning system 10, as described above, may further include a controller 50 that is configured to control if and when each of the plurality of the detonation tubes 20 is fired. As shown in FIG. 7, the controller 50 may be operably coupled to each of the plurality of the detonators 30 corresponding to each one of the plurality of the detonation tubes 20. With this arrangement, the controller 50 can control when a detonator 30 is actuated to thereby permit or inhibit combustion in a given one of the plurality of the detonation tubes 20. For example, the controller 50 can cause each one of the plurality of the detonators 30 to be fired substantially simultaneously and/or in accordance with a predefined sequence.

Although described above and in the figures as having a circular and cylindrical shape, it is to be understood that the common tube 11 may have various shapes, sizes and/or orientations. For example, the common tube 11 may be circular and cylindrical, square/rectangular, triangular, regular, irregular, parabolic and/or other similar shapes and orientations. Where the common tube 11 is parabolic, for example, the common tube 11 may be fluidly coupled to one or more detonation tubes 20 or one or more transition pieces 40 in accordance with the descriptions provided herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A pulse detonation cleaning system, comprising:

a common tube, which is fluidly coupled to a vessel;

a first array, including a plurality of elongate detonation tubes arrayed about a common axis, each of the plurality of the detonation tubes being disposed upstream from and fluidly coupled to an interior of the common tube;

a second array, including a plurality of detonators arrayed about the common axis, each of the plurality of the detonators being disposed upstream from and operably coupled to a corresponding one of the plurality of the detonation tubes such that actuation of each of the plurality of the detonators leads to combustion in the corresponding one of the plurality of the detonation tubes; and wherein the common tube is straight and has a correspondingly straight longitudinal axis, and wherein longitudinal axes of the plurality of the detonation tubes and the plurality of the detonators are transversely non-parallel with respect to the longitudinal axis of the common tube.

2. The pulse detonation cleaning system according to claim 1, wherein the common tube comprises:

a sidewall having an interior facing, substantially cylindrical surface defining the interior; and a cover plate attachable to the sidewall and interposed between the common tube and the first array.

3. The pulse detonation cleaning system according to claim 1, wherein each of the plurality of the detonation tubes is displaced from an adjacent one of the plurality of the detonation tubes.

4. The pulse detonation cleaning system according to claim 1, wherein 4 or more of the plurality of the detonation tubes and 4 or more of the plurality of the detonators are arrayed about the common axis.

5. The pulse detonation cleaning system according to claim 1, wherein 8 or more of the plurality of the detonation tubes and 8 or more of the plurality of the detonators are arrayed about the common axis.

6. The pulse detonation cleaning system according to claim 1, further comprising a transition piece fluidly coupled to and interposed between each of the plurality of the detonation tubes and the common vessel, the transition piece of each detonation tube comprising:

an upstream end disposed along the longitudinal axis of the corresponding detonation tube;

a downstream end disposed along the longitudinal axis of the common tube; and a sidewall formed to define a curved pathway from the upstream end to the downstream end.

7. The pulse detonation cleaning system according to claim 6, wherein 4 transition pieces are disposed in a rectangular array.

8. The pulse detonation cleaning system according to claim 6, wherein 3 transition pieces are disposed in a triangular array.

9. The pulse detonation cleaning system according to claim 6, wherein the transition piece has about a 90 degree curvature from an upstream end thereof to a downstream end thereof.

10. The pulse detonation cleaning system according to claim 6, wherein the transition piece increases in width from an upstream end thereof to a downstream end thereof

11. The pulse detonation cleaning system according to claim 6, wherein the transition piece increases in width from an upstream end thereof to a downstream end thereof with a curved shape such that fluid flowing into the upstream end flows in a first direction and fluid flowing out of the downstream end flows in a second direction transverse to the first direction, the corresponding detonation tube being coupled to the upstream end and having a uniform width, which is similar to a width of the upstream end, and the common vessel being coupled to the downstream end and having a uniform width, which is similar to a width of the downstream end.

12. The pulse detonation cleaning system according to claim 1, wherein each of the plurality of the detonators comprises:

an initiator to initiate a detonation leading to combustion in the corresponding one of the plurality of the detonation tubes;

a fuel supply line by which fuel is deliverable to the corresponding one of the plurality of the detonation tubes, the initiator being disposed along a side of the fuel supply line such that respectively portions of the initiator and the fuel supply line are disposed in parallel and a downstream portion of the initiator is angled toward the fuel supply line;

a valve, fluidly interposed between the initiator, the fuel supply line and the corresponding one of the plurality of the detonation tubes, to permit or inhibit the delivery of the fuel; and a support structure to mechanically support the initiator and the fuel supply line.

13. The pulse detonation cleaning system according to claim 12, wherein each support structure comprises:

first and second members extending transversely with respect to the common axis to support the initiator and the fuel supply line; and a connecting member extending along the common axis, which is supportively coupled to the first and second members.

14. The pulse detonation cleaning system according to claim 1, further comprising a controller to control a firing of each of the plurality of the detonators.

15. The pulse detonation cleaning system according to claim 1, wherein each of the plurality of the detonators is fired simultaneously.

16. The pulse detonation cleaning system according to claim 1, wherein each of the plurality of the detonators is fired in accordance with a predefined sequence.

17. A pulse detonation cleaning system, comprising:

a common tube having a sidewall having an interior facing, cylindrical surface formed to define a common tube interior, which is fluidly coupled to a boiler interior;

a first array, including a plurality of elongate detonation tubes arrayed about a common axis, each of the plurality of the detonation tubes being disposed upstream from and fluidly coupled to the common tube interior at a radial location proximate to the interior facing surface;

a second array, including a plurality of detonators arrayed about the common axis, each of the plurality of the detonators being disposed upstream from and operably coupled to a corresponding one of the plurality of the detonation tubes such that actuation of each of the plurality of the detonators leads to combustion in the corresponding one of the plurality of the detonation tubes; and wherein the common tube is straight and has a correspondingly straight longitudinal axis, and wherein longitudinal axes of the plurality of the detonation tubes and the plurality of the detonators are transversely non-parallel with respect to the longitudinal axis of the common tube.

18. A pulse detonation cleaning system, comprising:

a common tube having a sidewall having an interior facing surface formed to define a common tube interior, which is fluidly coupled to a boiler interior;

a first array, including a plurality of elongate detonation tubes arrayed with longitudinal axes thereof transversely oriented with respect to a longitudinal axis of the common tube;

a plurality of curved transition pieces, each of the plurality of the transition pieces being fluidly interposed between a corresponding one of the plurality of the detonation tubes and the common tube interior at a radial location proximate to the interior facing surface; and a second array, including a plurality of detonators arrayed with longitudinal axes thereof transversely oriented with respect to the longitudinal axis of the common tube, each of the plurality of the detonators being disposed upstream from and operably coupled to a corresponding one of the plurality of the detonation tubes such that actuation of each of the plurality of the detonators leads to combustion in the corresponding one of the plurality of the detonation tubes, each transition piece comprising:

an upstream end disposed along the longitudinal axis of the corresponding detonation tube and corresponding detonators;

a downstream end disposed along the longitudinal axis of the common tube; and a sidewall formed to define a curved pathway from the upstream end to the downstream end that increases in width from the upstream end to the downstream end.

* * * * *